US008508440B2

(12) United States Patent
Kim

(10) Patent No.: US 8,508,440 B2
(45) Date of Patent: Aug. 13, 2013

(54) ORGANIC LIGHT EMITTING DISPLAY, AND METHOD FOR DRIVING ORGANIC LIGHT EMITTING DISPLAY AND PIXEL CIRCUIT

(75) Inventor: Yang Wan Kim, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 1533 days.

(21) Appl. No.: 11/271,523

(22) Filed: Nov. 10, 2005

(65) Prior Publication Data

US 2006/0114199 A1 Jun. 1, 2006

(30) Foreign Application Priority Data

Nov. 17, 2004 (KR) ..... 10-2004-0094123
Nov. 17, 2004 (KR) ..... 10-2004-0094124

(51) Int. Cl.

| | |
|---|---|
| ***G09G 3/28*** | (2006.01) |
| ***G09G 3/30*** | (2006.01) |
| ***G09G 3/32*** | (2006.01) |
| ***G09G 5/10*** | (2006.01) |

(52) U.S. Cl.
USPC ..... 345/77; 345/63; 345/82; 345/690

(58) Field of Classification Search
USPC ..... 345/82, 76, 77, 63, 690; 315/169.3
See application file for complete search history.

(56) References Cited

U.S. PATENT DOCUMENTS 5,748,164 A * 5/1998 Handschy et al. ..... 345/89
6,256,005 B1 * 7/2001 Kim ..... 345/88
6,362,798 B1 3/2002 Kimura et al.
6,788,003 B2 9/2004 Inukai et al.
6,788,277 B2 9/2004 Kanauchi et al.
7,176,879 B1 * 2/2007 Yoshihara et al. ..... 345/102

(Continued)

FOREIGN PATENT DOCUMENTS

CN 1369916 A 9/2002
CN 1471069 A 1/2004

(Continued)

OTHER PUBLICATIONS

Patent Gazette for corresponding Chinese Patent Publication CN 100444225C dated Dec. 17, 2008.

(Continued)

*Primary Examiner* — Bipin Shalwala
*Assistant Examiner* — Benyam Ketema
(74) *Attorney, Agent, or Firm* — Christie, Parker & Hale, LLP

(57) ABSTRACT

An organic light emitting display, and a method for driving an organic light emitting display and a pixel circuit capable of improving a uniformity of a luminance. In the organic light emitting display, a scan driver sequentially supplies a scan signal to a plurality of scan lines during each of a plurality of sub-frames included in one frame. A data driver applies a data voltage to a plurality of data lines during at least one light emitting sub-frame of the plurality of sub-frames included in the one frame, and applies a voltage corresponding to a black gradation to the plurality of data lines during at least one non-light emitting sub-frame of the plurality of sub-frames included in the one frame. A pixel portion displays an image according to the scan signal supplied to the plurality of scan lines and according to the data voltage and the voltage corresponding to the black gradation applied to the plurality of data lines.

10 Claims, 6 Drawing Sheets

(56) References Cited

U.S. PATENT DOCUMENTS

| | | | | |
|---|---|---|---|---|
| 2001/0045928 | A1* | 11/2001 | Zavracky et al. | 345/88 |
| 2002/0196220 | A1* | 12/2002 | Sato et al. | 345/87 |
| 2003/0174153 | A1* | 9/2003 | Koyama | 345/690 |
| 2003/0197472 | A1* | 10/2003 | Kanauchi et al. | 315/169.1 |
| 2004/0036664 | A1* | 2/2004 | Miyazawa | 345/76 |
| 2004/0104870 | A1* | 6/2004 | Mametsuka | 345/76 |
| 2004/0145547 | A1* | 7/2004 | Oh | 345/76 |
| 2004/0251819 | A1* | 12/2004 | Hsueh | 313/506 |
| 2005/0001795 | A1 | 1/2005 | Kitahara | |
| 2005/0116656 | A1* | 6/2005 | Shin | 315/169.3 |
| 2005/0168491 | A1 | 8/2005 | Takahara et al. | |
| 2006/0044241 | A1* | 3/2006 | Yuh-Ren et al. | 345/89 |
| 2006/0139266 | A1* | 6/2006 | Choi | 345/77 |
| 2007/0229438 | A1* | 10/2007 | Shin | 345/99 |
| 2007/0279345 | A1* | 12/2007 | Kim | 345/80 |

FOREIGN PATENT DOCUMENTS

| | | | |
|---|---|---|---|
| EP | 1 372 136 | A1 | 12/2003 |
| EP | 1372 136 | A1 | 12/2003 |
| JP | 2003-330422 | | 11/2003 |
| JP | 2004-070293 | | 3/2004 |
| JP | 2004069788 | * | 3/2004 |
| JP | 2004-151558 | | 5/2004 |
| JP | 2004-170787 | | 6/2004 |
| KR | 10-2004-0018811 | | 3/2004 |
| WO | WO 98/36407 | | 8/1998 |
| WO | WO 03/065336 | * | 8/2003 |

OTHER PUBLICATIONS

European Search Report dated May 30, 2006 for European application 05110680.5 in the name of Samsung SDI Co., Ltd.

Korean Patent Abstracts, Publication No. 1020040018811 A, dated Mar. 4, 2004, in the name of Dong Yong Shin.

* cited by examiner

ORGANIC LIGHT EMITTING DISPLAY, AND METHOD FOR DRIVING ORGANIC LIGHT EMITTING DISPLAY AND PIXEL CIRCUIT

CROSS-REFERENCE TO RELATED APPLICATIONS

This application claims priority to and the benefit of Korean Patent Applications No. 10-2004-0094123 and 10-2004-0094124, filed on Nov. 17, 2004, in the Korean Intellectual Property Office, the entire contents of which are incorporated herein by reference.

BACKGROUND

1. Field of the Invention

The present invention relates to an organic light emitting display, and a method for driving an organic light emitting display and a pixel circuit, and more particularly to an organic light emitting display, and a method for driving an organic light emitting display and a pixel circuit capable of improving a uniformity of a luminance.

2. Discussion of Related Art

Recently, various flat panel displays have been developed to substitute for cathode ray tube (CRT) displays because the CRT displays are relatively heavy and bulky. Flat panel displays include liquid crystal displays (LCDs), field emission displays (FEDs), plasma display panel (PDP) displays, and organic light emitting displays.

Among the flat panel displays, the organic light emitting displays are self-emission devices that can emit light by recombination of electrons and holes. The organic light emitting display may be referred to as an organic electroluminescent display. The organic light emitting display has a high response speed that is more like the response speed of the CRT display than the response speed of the slower LCD that requires additional light source.

The organic light emitting display can be driven by a passive matrix method or an active matrix method. According to the passive matrix method, an anode and a cathode are formed to intersect (or cross-over) each other and a line is selected to be driven. According to the active matrix method, the amount of current that flows through an electroluminescent device (e.g., an organic light emitting diode (OLED)) is controlled by an active device. A thin film transistor (hereinafter, referred to as TFT) is mainly used as the active device. While the active matrix method is more complicated than the passive matrix method, it has advantages in that the amount of power consumption is small and that emission time is long.

However, when threshold voltages of TFTs are not uniform, the active matrix type organic light emitting display may not have uniform screen luminance. In particular, when an organic light emitting diode (OLED) continuously emits light during one frame, an influence due to an error of the threshold voltage is accumulated, thus further deteriorating the non-uniformity of the screen luminance.

SUMMARY OF THE INVENTION

Accordingly, it is an embodiment of the present invention to provide an organic light emitting display, and a method for driving an organic light emitting display and a pixel circuit capable of improving a uniformity of a luminance Another embodiment of the present invention is to provide an organic light emitting display and a driving method thereof capable of adjusting a white balance.

In one embodiment of the present invention, an organic light emitting display includes: a scan driver for sequentially supplying a scan signal to a plurality of scan lines during each of a plurality of sub-frames included in one frame; a data driver for applying a data voltage to a plurality of data lines during at least one light emitting sub-frame of the plurality of sub-frames included in the one frame, and for applying a voltage corresponding to a black gradation to the plurality of data lines during at least one non-light emitting sub-frame of the plurality of sub-frames included in the one frame; and a pixel portion for displaying an image according to the scan signal supplied to the plurality of scan lines and according to the data voltage and the voltage corresponding to the black gradation applied to the plurality of data lines.

According to another embodiment of the present invention, there is provided a method for driving an organic light emitting display, the organic light emitting display including a scan driver for supplying a scan signal to a plurality of scan lines, a data driver for applying a voltage to a plurality of data lines, and a pixel portion for displaying an image according to the scan signal supplied to the plurality of scan lines and according to the voltage applied to the plurality of data lines, the method including: (a) sequentially supplying the scan signal to the plurality of scan lines, and applying a data voltage to the plurality of data lines during a light emitting period; and (b) sequentially supplying the scan signal to the plurality of scan lines, and applying a predetermined voltage to the plurality of data lines during a non-light emitting period. In one embodiment, the predetermined voltage is a voltage corresponding to a black gradation.

According to yet another embodiment of the present invention, there is provided a method for driving a pixel circuit during one frame. The pixel circuit includes a first transistor for applying a voltage to be applied to a data line according to a scan signal supplied to a scan line, a capacitor for storing a voltage corresponding to the applied voltage, and a second transistor for applying a current corresponding to the voltage stored in the capacitor to an organic light emitting diode. The one frame period includes at least one light emitting sub-frame and at least one non-light emitting sub-frame. The method for driving the pixel circuit during the at least one light emitting sub-frame includes: storing a voltage corresponding to a data voltage to be applied to the data line while the scan signal is supplied to the scan line; and applying a current corresponding to the voltage stored in the capacitor to the organic light emitting diode. The method for driving the pixel circuit during the at least one non-light emitting sub-frame includes: storing a voltage corresponding to a black gradation to be applied to the data line while the scan signal is supplied to the scan line; and applying a current corresponding to the voltage stored in the capacitor to the organic light emitting diode.

According to yet another embodiment of the present invention, there is provided an organic light emitting display including: a pixel portion including a plurality of red pixels connected to a plurality of scan lines and a red data line, a plurality of green pixels connected to the plurality of scan lines and a green data line, and a plurality of blue pixels connected to the plurality of scan lines and a blue data line, and for displaying one image during one frame; a scan driver for sequentially supplying a scan signal to the plurality of scan lines during each of a plurality of sub-frames included in the one frame; and a data driver for supplying a data signal to the red data lines during red light emitting sub-frames of the plurality of sub-frames included in the one frame and a signal corresponding to a black gradation to the red data line during non-red light emitting sub-frames of the plurality of sub-frames included in the one frame, for supplying the data signal to the green data line during green light emitting sub-frames of the plurality of sub-frames included in the one frame and the signal corresponding to the black gradation to the green data line during non-green light emitting sub-frames of the plurality of sub-frames included in the one frame, and for supplying the data signal to the blue data line during blue light emitting sub-frames of the plurality of sub-frames included in the one frame and the signal corresponding to the black gradation to the blue data line during non-blue light emitting sub-frames of the plurality of sub-frames include in the one frame, wherein the red light emitting sub-frames have a first number of sub-frames, the green light emitting sub-frames have a second number of sub-frames, and the blue light emitting sub-frames have a third number of sub-frames, and wherein at least one of the first number, the second number, and the third number is different from the remaining numbers.

According to a further embodiment of the present invention, there is provided a method for driving an organic light emitting display displaying one image during one frame, the method for driving the organic light emitting display during the one frame including: (a) sequentially supplying a scan signal to a plurality of scan lines, and applying a first data voltage to a data line connected to a red pixel, a data line connected to a green pixel, and a data line connected to a blue pixel; (b) sequentially supplying the scan signal to the plurality of scan lines, and applying a second data voltage to at least one of the data line connected to the red pixel, the data line connected to the green pixel, and the data line connected to the blue pixel, and applying a predetermined voltage to the remaining data lines; and (c) sequentially supplying the scan signal to the plurality of scan lines, and applying the predetermined voltage to the data line connected to the red pixel, the data line connected to the green pixel, and the data line connected to the blue pixel.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
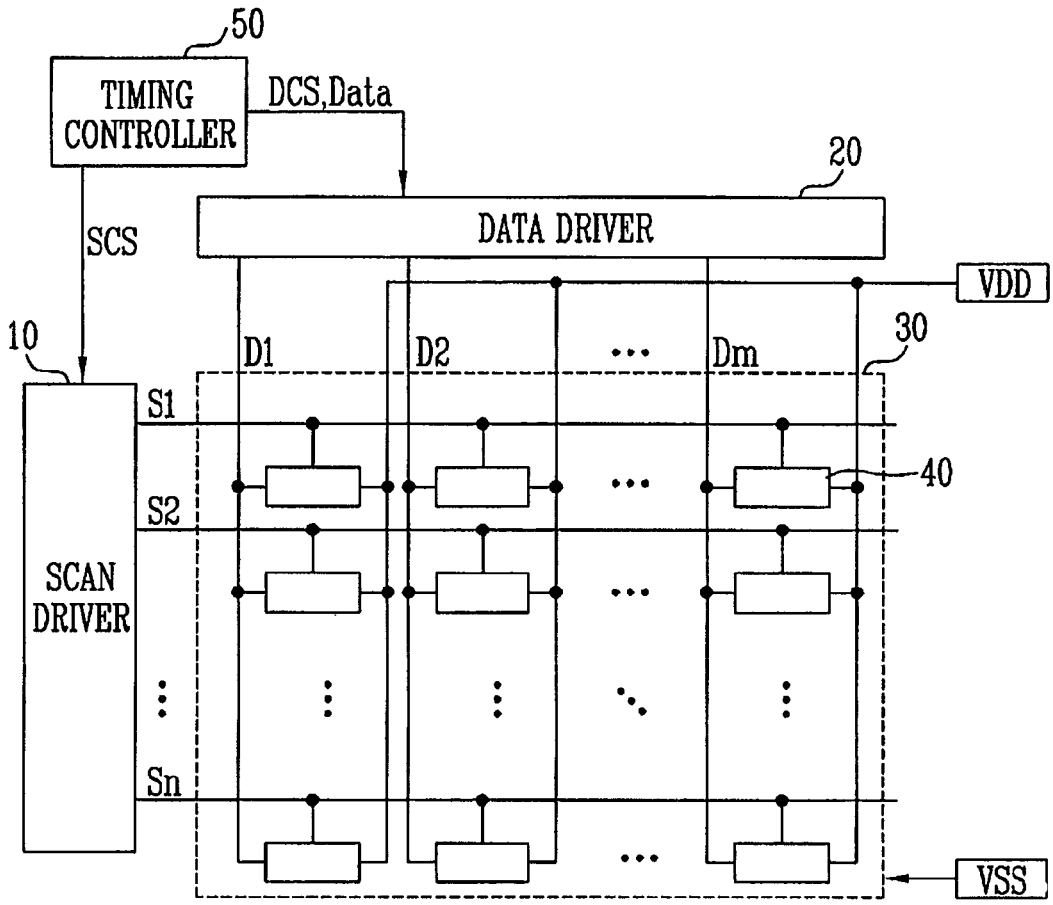
FIG. 1 is a view showing an organic light emitting display according to a first embodiment of the present invention.

In the following detailed description, certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive. There may be parts shown in the drawings, or parts not shown in the drawings, that are not discussed in the specification as they are not essential to a complete understanding of the invention. Like reference numerals designate like elements. Here, when a first element is connected to a second element, the one element may be not only directly connected to the element but also indirectly connected to the second element via a third element.

FIG. 1 is a view showing an organic light emitting display according to a first embodiment of the present invention. With reference to FIG. 1, the organic light emitting display includes a scan driver 10, a data driver 20, a pixel portion 30, and a timing controller 50.

The scan driver 10 drives scan lines S1 through Sn. The scan driver 10 generates a scan signal in response to a scan driver control signal SCS, and sequentially supplies the generated scan signal to the scan lines S1 through Sn. The scan driver 10 sequentially provides the scan signal to the scan lines S1 through Sn during every sub-frame.

The data driver 20 drives data lines D1 through Dm. The data driver 20 generates data voltages in response to data driver control signals DCS and video data Data, and provides the generated data voltages to the data lines D1 to Dm. The data driver 20 supplies data voltages to the data lines D1 through Dm during a light emitting sub-frame period among a plurality of sub-frames constituting one frame, whereas it supplies a voltage corresponding to a black gradation to the data lines D1 through Dm during a non-light emitting sub-frame period among the plurality of sub-frames forming the one frame. In one embodiment, the data driver 20 selects for itself the data voltages and the voltage corresponding to the black gradation in order to perform the above described voltage supplying operation. Alternatively, the data driver 20 receives video data corresponding to the black gradation from the timing controller 50 in order to carry out the aforementioned operation. In the latter case, the timing controller 50 should be able to apply video data corresponding to video data inputted to the timing controller 50 during a predetermined time (or light emitting) period to the data driver 20, and video data corresponding to the black gradation during the remaining time periods to the data driver 20.

The pixel portion 30 includes a plurality of pixels 40 connected to the scan lines S1 to Sn and the data lines D1 to Dm. Furthermore, the pixel portion 30 receives a first source voltage VDD of a first external voltage source and a second source voltage VSS of a second external voltage source. Here, the first source voltage VDD and the second source voltage VSS are applied to respective pixels 40. Each of the pixels 40 displays an image corresponding to a data signal supplied thereto.

The timing controller 50 supplies the scan driver control signal SCS to the scan driver 10, and provides the data driver control signal DCS and the video data Data to the data driver 20.

Figure 2:
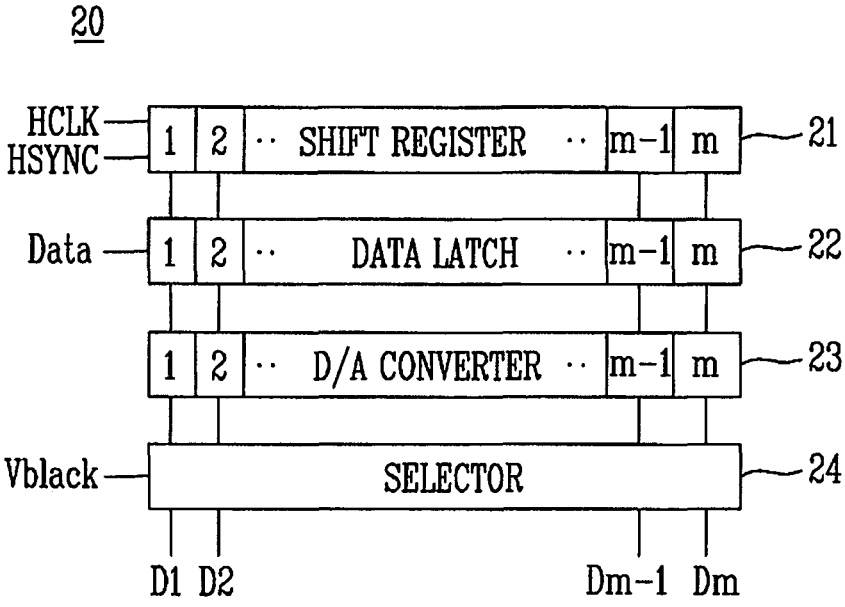
FIG. 2 is a view showing an example of a data driver used in the organic light emitting display shown in FIG. 1.

FIG. 2 is a view showing an example of the data driver 20 used in the organic light emitting display shown in FIG. 1, in particular, an example of a case where the data driver 20 selects for itself data voltages and a voltage corresponding to a black gradation.

Referring to FIG. 2, the data driver 20 includes a shift register 21, a data latch 22, a digital/analog (referred to as D/A hereinafter) converter 23, and a selector 24. The shift register 21 controls the data latch 22 in response to a horizontal clock signal HCLK and a horizontal sync signal HSYNC. The horizontal clock signal HCLK and the horizontal sync signal HSYNC are a kind of the data driver control signal DCS of FIG. 1. The data latch 22 sequentially receives video data Data and outputs the received video data Data to the D/A converter 23 in parallel. The data latch 22 is controlled by a control signal outputted from the shift register 21. The D/A converter 23 converts the video data received from the data latch 22 in parallel into analog voltages. The selector 24 outputs the output voltages of the D/A converter 23 to the data lines D1 through Dm during the light emitting sub-frame period, and outputs a voltage $V_{black}$ corresponding to a black gradation to the data lines D1 through Dm during the non-light emitting sub-frame period.

Figure 3:
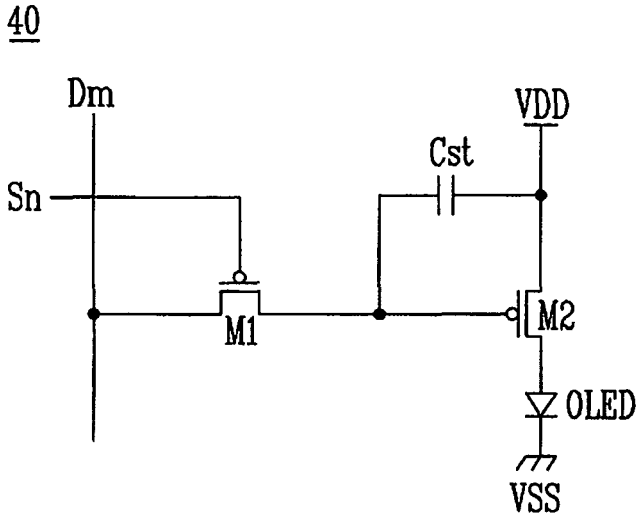
FIG. 3 is a circuit diagram showing an example of a pixel used in the organic light emitting display shown in FIG. 1.

FIG. 3 is a circuit diagram showing an example of the pixel 40 used in the organic light emitting display shown in FIG. 1. The pixel 40 includes an organic light emitting diode OLED and a pixel circuit. The pixel circuit includes a switch transistor M1, a drive transistor M2, and a capacitor Cst. The switch transistor M1 applies a data voltage applied to the data line Dm to the capacitor Cst according to a scan signal supplied to the scan line Sn. The capacitor Cst stores the applied data voltage during a supplied period of the scan signal, and maintains the stored data voltage during a period when the scan signal is not supplied. The drive transistor M2 applies a current corresponding to the voltage of the capacitor Cst to the organic light emitting diode OLED. The organic light emitting diode OLED emits light according to the applied current. The first source voltage VDD is applied to a source of the drive transistor M2, and the second source voltage VSS is applied to the organic light emitting diode OLED.

Figure 4:
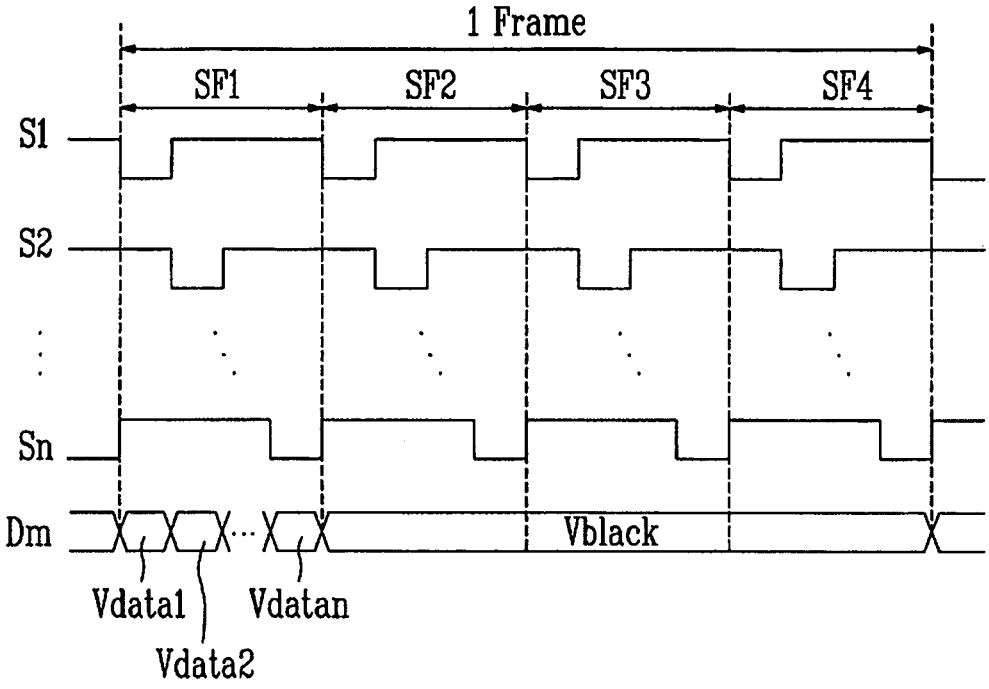
FIG. 4 is a timing chart for illustrating a method for driving the organic light emitting display shown in FIG. 1.

FIG. 4 is a timing chart for illustrating a method for driving the organic light emitting display shown in FIG. 1. Referring to FIG. 1 and FIG. 4, one frame is composed of a plurality of sub-frames. More particularly, the one frame of FIG. 4 is shown to be composed of 4 sub-frames SF1, SF2, SF3, and SF4. A scan signal is sequentially supplied to the scan lines S1 to Sn during respective sub-frame periods.

The first sub-frame SF1 is a light-emitting sub-frame. When a scan signal of the first sub-frame SF1 is provided, data voltages $V_{data}$1 to $V_{data}$n are applied to the data line Dm. Accordingly, the pixel portion 30 emits light corresponding to $V_{data}$1 to $V_{data}$n applied during the period of the first sub-frame SF1.

The second to fourth sub-frames SF2 to SF4 are non-light emitting sub-frames. When the scan signal of the second to fourth sub-frames SF2 to SF4 is provided, a voltage $V_{black}$ corresponding to a black gradation is applied to the data line Dm. Accordingly, the pixel portion 30 displays an image corresponding to a black gradation according to the voltage $V_{black}$ corresponding to a black gradation applied during the periods of the second to fourth sub-frames SF2 to SF4.

Although the number of the sub-frames is four in FIG. 4, the present invention is not thereby limited. That is, as long as the number of the sub-frames is two or more, aspect(s) of the present invention can be realized. Furthermore, in FIG. 4, only the first sub-frame SF1 is a light-emitting sub-frame, and remaining sub-frames SF2, SF3, and SF4 are non-light emitting sub-frames. However, among a plurality of sub-frames, when at least one sub-frame is a light-emitting sub-frame, and at least one sub-frame is a non-light emitting sub-frame, aspect(s) of the present invention can be obtained. If at least two sub-frames are non-light emitting sub-frames, all the light emitting sub-frames included in one frame can have either the same data voltage or different data voltages to be applied to one pixel. In FIG. 4, lengths of four sub-frames are identical with each other. However, even when lengths of sub-frames forming one frame are different from each other, aspect(s) of the present invention can be achieved. In FIG. 4, a light-emitting sub-frame is positioned at a front part of one frame. However, aspect(s) of the present invention can be realized even if the light-emitting sub-frame is positioned at a middle or back part of one frame.

A voltage corresponding to a black gradation is a voltage required when a pixel displays the black gradation. However, since an error of a threshold voltage $V_{TH}$ can occur in every pixel, a voltage corresponding to the black gradation in one pixel can be a voltage corresponding to a gray gradation (i.e., non-black gradation) in another pixel having a threshold voltage of a great error. One example of the voltage corresponding to the black gradation may be a first source voltage VDD.

Hereinafter, how an error $\Delta V_{th}$ of a threshold voltage of a conventional organic light emitting display and an error $\Delta V_{th}$ of a threshold voltage of an organic light emitting display according to the first embodiment of the present invention can affect an average of a luminance error, namely, an error average $E(\Delta I_{OLED})$ of a current flowing through an organic light emitting diode, will be described. A current flowing through an organic light emitting diode OLED when light is continuously emitted during one frame period according to an conventional case is expressed by a following equation 1.

$$I_{OLED1} = I_D = \frac{\beta}{2}(V_{GS1} - V_{TH})^2 \tag{1}$$

where, $I_{OLED1}$ is a current flowing through the conventional organic light emitting diode OLED, $I_D$ is a current flowing from a source of a drive transistor to a drain thereof, $V_{GS1}$ is a voltage between a gate and a source of the conventional drive transistor, $V_{th}$ is a threshold voltage of the drive transistor, and $\beta$ is a gain factor of the drive transistor.

When an error $\Delta V_{th}$ occurs in a threshold voltage of a conventional organic light emitting display, an error $\Delta I_{OLED1}$ of a current through the organic light emitting diode is expressed by a following equation 2.

$$\begin{aligned}\Delta I_{OLED1} &= \frac{\beta}{2}(V_{GS1} - V_{TH} + \Delta V_{th})^2 - \frac{\beta}{2}(V_{GS1} - V_{TH})^2 \\ &= \frac{\beta}{2}(2\Delta V_{th}(V_{GS1} - V_{TH}) + \Delta V_{th}^2)\end{aligned} \tag{2}$$

In the conventional organic light emitting display, since the same current flows during the periods of all sub-frames of one frame, the error average $E(\Delta I_{OLED})$ of a current flowing through an organic light emitting diode is identical with the error $\Delta I_{OLED1}$ of a current flowing through the organic light emitting diode. That is, the error average $E(\Delta I_{OLED})$ of a current flowing through an organic light emitting diode can be expressed by a following equation 3.

$$E(\Delta I_{OLED1}) = I_{OLED1} = \frac{\beta}{2}(2\Delta V_{th}(V_{GS1} - V_{TH}) + \Delta V_{th}^2) \tag{3}$$

In the organic light emitting display according to the present invention, when an error $\Delta V_{th}$ occurs in a threshold voltage, an error $\Delta I_{OLED2}$ of a current flowing through the organic light emitting diode is expressed by a following equation 4.

$$\Delta I_{OLED2} = \frac{\beta}{2}(V_{GS2} - V_{TH} + \Delta V_{th})^2 - \frac{\beta}{2}(V_{GS2} - V_{TH})^2 \quad (4)$$

where, $V_{GS2}$ is a voltage between a gate and a source of the drive transistor M2 according to the present invention.

Assuming that one frame has N number of sub-frames, only a first sub-frame among sub-frames emits light according to a data voltage $V_{data}$, the remaining sub-frames display a luminance of a black gradation according to a voltage of an off state by the organic light emitting display according to the embodiment of the present invention and the luminance is in proportion to the current flowing through the organic light emitting diode, then, if it is satisfied that $V_{GS2}-V_{TH}=(V_{GS1}-V_{TH})\sqrt{N}$ the first sub-frame, a driving method according to the first embodiment of the present invention and a conventional driving method display the same luminance with respect to one frame on the average. Accordingly, the error $\Delta I_{OLED2}$ can be expressed by a following equation 5.

$$\begin{aligned}\Delta I_{OLED2} &= \frac{\beta}{2}\left((V_{GS1} - V_{TH})\sqrt{N} + \Delta V_{th}\right)^2 - \\ &\quad \frac{\beta}{2}\left((V_{GS1} - V_{TH})\sqrt{N}\right)^2 \\ &= \frac{\beta}{2}\left(2\Delta V_{th}(V_{GS1} - V_{TH})\sqrt{N} + \Delta V_{th}^2\right)\end{aligned} \quad (5)$$

Since the organic light emitting diode of the present invention emits light during only the period of the first sub-frame period among the periods of all sub-frames of one frame and it is tuned off during the period of the remaining sub-frame period, an error average $E(\Delta I_{OLED2})$ of a current flowing through an organic light emitting diode can be expressed by a following equation 6.

$$E(\Delta I_{OLED2}) = \frac{\Delta I_{OLED2}}{N} = \frac{\beta}{2}\left(\frac{2\Delta V_{th}(V_{GS1} - V_{TH})\sqrt{N}}{N} + \frac{\Delta V_{th}^2}{N}\right) \quad (6)$$

When comparing the equation 6 expressing the error average $E(\Delta I_{OLED2})$ of the current of the organic light emitting display of the present invention with the equation 3 expressing the error average $E(\Delta I_{OLED2})$ of the current of the conventional organic light emitting display, as the number of sub-frames N is increased, the error average $E(\Delta I_{OLED2})$ of the current is dramatically reduced. Accordingly, the organic light emitting display of the present invention reduces an influence of an error of a threshold voltage on a luminance, thereby improving the uniformity of the luminance.

In an alternative driving method having similar effects, a control transistor operating according to a light emitting control signal is added between the drive transistor M2 of FIG. 3 and the organic light emitting diode OLED of FIG. 3. The method controls whether or not a current is supplied to the organic light emitting diode OLED according to a light emitting control signal provided to the control transistor. That is, this alternative method also divides one frame into a light emitting period and a non-light emitting period. However, in such driving method, since the control transistor operating according to the light emitting control signal is added, a complexity is increased, due to the additional control transistor and the additionally generated light emitting control signal. In addition, a new scan driver needs to be designed and a light emitting control line for applying the light emitting control signal to a pixel needs to be added. Accordingly, this alternative method may reduce an aperture ratio of a display. In contrast to this, in an organic light emitting display according to the first embodiment of the present invention, an addition of a transistor operating according to the light emitting control signal, an addition of the light emitting control line for applying the light emitting control signal, and a design of a new scan driver are not required. The first embodiment of the present invention has an advantage in that one frame can be divided into a light emitting period and a non-light emitting period by using a widely used scan driver.

Figure 5:
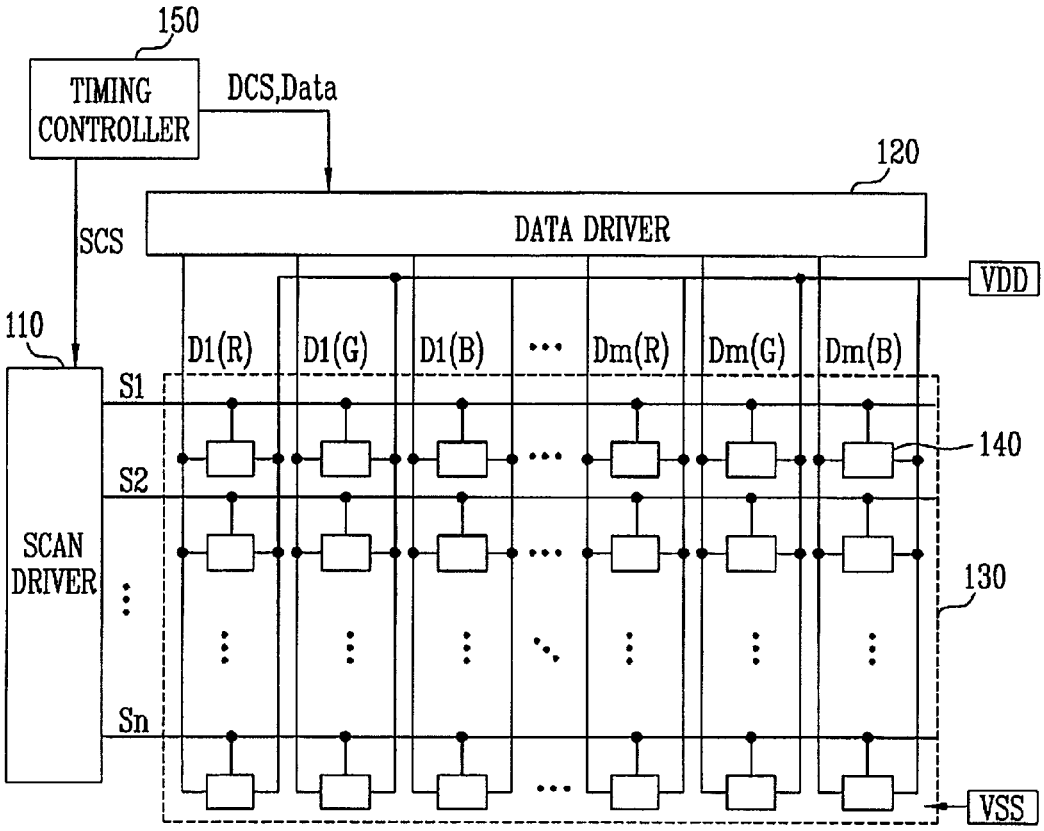
FIG. 5 is a view showing an organic light emitting display according to a second embodiment of the present invention.

FIG. 5 is a view showing an organic light emitting display according to a second embodiment of the present invention. With reference to FIG. 5, the organic light emitting display includes a scan driver 110, a data driver 120, a pixel portion 130, and a timing controller 150. The organic light emitting display displays an image on the pixel portion 130 in frames. One frame includes a plurality of sub-frames.

The scan driver 110 drives scan lines S1 through Sn. The scan driver 110 generates a scan signal in response to a scan driver control signal SCS, and sequentially supplies the generated scan signal to the scan lines S1 through Sn. The scan driver 110 sequentially provides the scan signal to the scan lines S1 through Sn during every sub-frame.

The data driver 120 drives data lines D1(R), D1(G), D1(B) through Dm(R), Dm(G), Dm(B). The data driver 120 generates data voltages in response to data driver control signals DCS and video data Data, and provides the generated data voltages to the data lines D1(R), D1(G), D1(B) through Dm(R), Dm(G), Dm(B). The data driver 120 supplies data voltages to the data lines D1(R), D1(G), D1(B) through Dm(R), Dm(G), Dm(B) during a light emitting sub-frame period among a plurality of sub-frames constituting one frame, whereas it supplies a voltage corresponding to a black gradation to the data lines D1(R), D1(G), D1(B) through Dm(R), Dm(G), Dm(B) during a non-light emitting sub-frame period among sub-frames forming one frame. In one embodiment, the data driver 120 selects for itself the data voltages and the voltage corresponding to the black gradation in order to perform the above described voltage supplying operation. Alternatively, the data driver 120 receives video data corresponding to the black gradation from the timing controller 150 in order to carry out the aforementioned operation. In the latter case, the timing controller 150 should be able to apply video data corresponding to video data inputted to the timing controller 150 during a predetermined (or light emitting) time period to the data driver 120, and video data corresponding to the black gradation during the remaining time periods to the data driver 120.

The pixel portion 130 includes a plurality of pixels 140 defined by the scan lines S1 to Sn and the data lines D1(R), D1(G), D1(B) through Dm(R), Dm(G), Dm(B). Furthermore, the pixel portion 130 receives a first source voltage VDD of a first external voltage source and a second external source voltage VSS of a second external voltage source. Here, the first source voltage VDD and the second source voltage VSS are applied to respective pixels 140. Each of the pixels 140 displays an image corresponding to a data signal supplied thereto.

The timing controller 150 supplies the scan driver control signal SCS to the scan driver 110, and provides the data driver control signal DCS and the video data Data to the data driver 120.

The video data Data may have red, green, and blue video data. The video data also has white video data.

On the other hand, although the same video data are supplied to an organic light emitting diode of an organic light emitting display, the light emitting diode emits light of different luminance according to material characteristics. For example, a light emitting efficiency of an organic green light emitting diode can be lower than that of the organic blue or red light emitting diode. As described above, when lights of different efficiencies in every organic light emitting diode are emitted, a white balance is not met, thereby causing an image of an undesirable color to be displayed. Accordingly, in the organic light emitting display according to an embodiment of the present invention, the number of light emitting sub-frames among sub-frames forming one frame is adjusted according to organic red, green, and blue light emitting diodes after consideration of the white balance. In other words, in the embodiment of the present invention, the number of light emitting sub-frames of data lines D_G1 to D_Gm for applying a data voltage to a green pixel is set to be the greatest value, whereas the number of light emitting sub-frames of data lines D1(B) to Dm(B) for applying the data voltage to a blue pixel and the number of light emitting sub-frames of data lines D1(R) to Dm(R) for applying the data voltage to a red pixel are set to be smaller values. Accordingly, the white balance of the red pixel, the green pixel, and the blue pixel is adjusted to thus improve a display quality.

Figure 6:
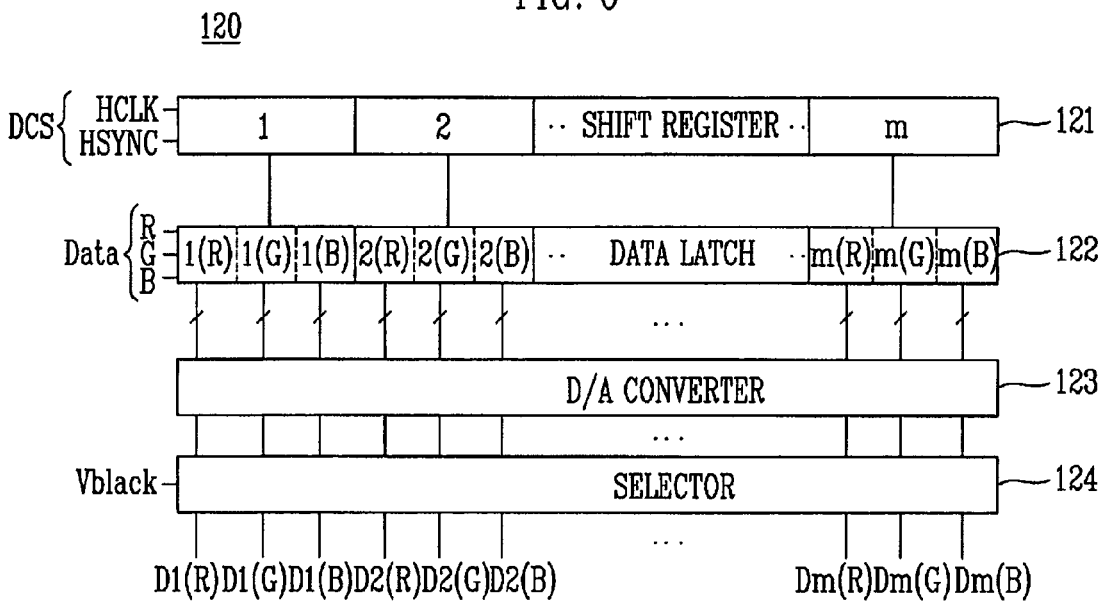
FIG. 6 is a view showing an example of a data driver used in the organic light emitting display shown in FIG. 5.

FIG. 6 is a view showing an example of the data driver 120 used in the organic light emitting display shown in FIG. 5, in particular, an example of a case where the data driver 120 selects for itself data voltages and a voltage corresponding to a black gradation.

Referring to FIG. 6, the data driver 120 includes a shift register 121, a data latch 122, a D/A converter 123, and a selector 124. The shift register 121 controls the data latch 122 in response to a horizontal clock signal HCLK and a horizontal sync signal HSYNC. The horizontal clock signal HCLK and the horizontal sync signal HSYNC are a kind of the data driver control signal DCS of FIG. 5. The data latch 122 sequentially receives red video data R, green video data G, and blue video data B, and outputs the received red, green, and blue video data R, G, and B to the D/A converter 123 in parallel. The data latch 122 is controlled by a control signal outputted from the shift register 121. The D/A converter 123 converts the video data received from the data latch 122 in parallel into analog voltages. The selector 124 outputs the output voltages of the D/A converter 123 to the data lines D1(R), D1(G), D1(B) through Dm(R), Dm(G), Dm(B) during the light emitting sub-frame period, and outputs a voltage $V_{black}$ corresponding to a black gradation to the data lines D1(R), D1(G), D1(B) through Dm(R), Dm(G), Dm(B) during the non-light emitting sub-frame period. In the embodiment of FIG. 6, the number of light emitting sub-frames among sub-frames forming one frame is adjusted according to organic red, green, and blue light emitting diodes after consideration of the white balance.

Figure 7:
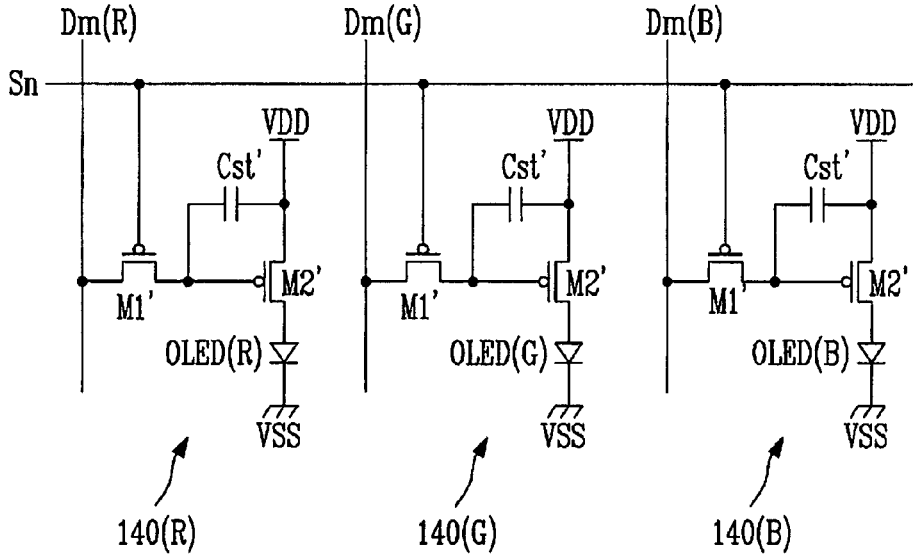
FIG. 7 is a circuit diagram showing an example of a pixel used in the organic light emitting display shown in FIG. 5.

FIG. 7 is a circuit diagram showing an example of the pixel 140 having a red pixel 140(R), a green pixel 140(G), and a blue pixel 140(B) used in the organic light emitting display shown in FIG. 5. The red pixel 140(R) includes an organic red light emitting diode OLED(R) and a first pixel circuit. The green pixel 140(G) includes an organic green light emitting diode OLED(G) and a second pixel circuit. The blue pixel 140(B) includes an organic blue light emitting diode OLED (B) and a third pixel circuit. Each of the first, second, and third pixel circuits includes a switch transistor M1', a drive transistor M2', and a capacitor Cst'.

The switch transistor M1' applies a data voltage applied to the data line Dm to the capacitor Cst' according to a scan signal supplied to the scan line Sn. The capacitor Cst' stores the applied data voltage during a supplied period of the scan signal, and maintains the stored data voltage during a period when the scan signal is not supplied. The drive transistor M2' applies a current corresponding to the voltage of the capacitor Cst' to its corresponding organic light emitting diode OLED (R), OLED(G), or OLED(B). The corresponding organic light emitting diode OLED(R), OLED(G), or OLED(B) emits light according to the applied current. The first source voltage VDD is applied to a source of the drive transistor M2', and the second source voltage VSS is applied to the corresponding organic light emitting diode OLED(R), OLED(G), or OLED (B).

Figure 8:
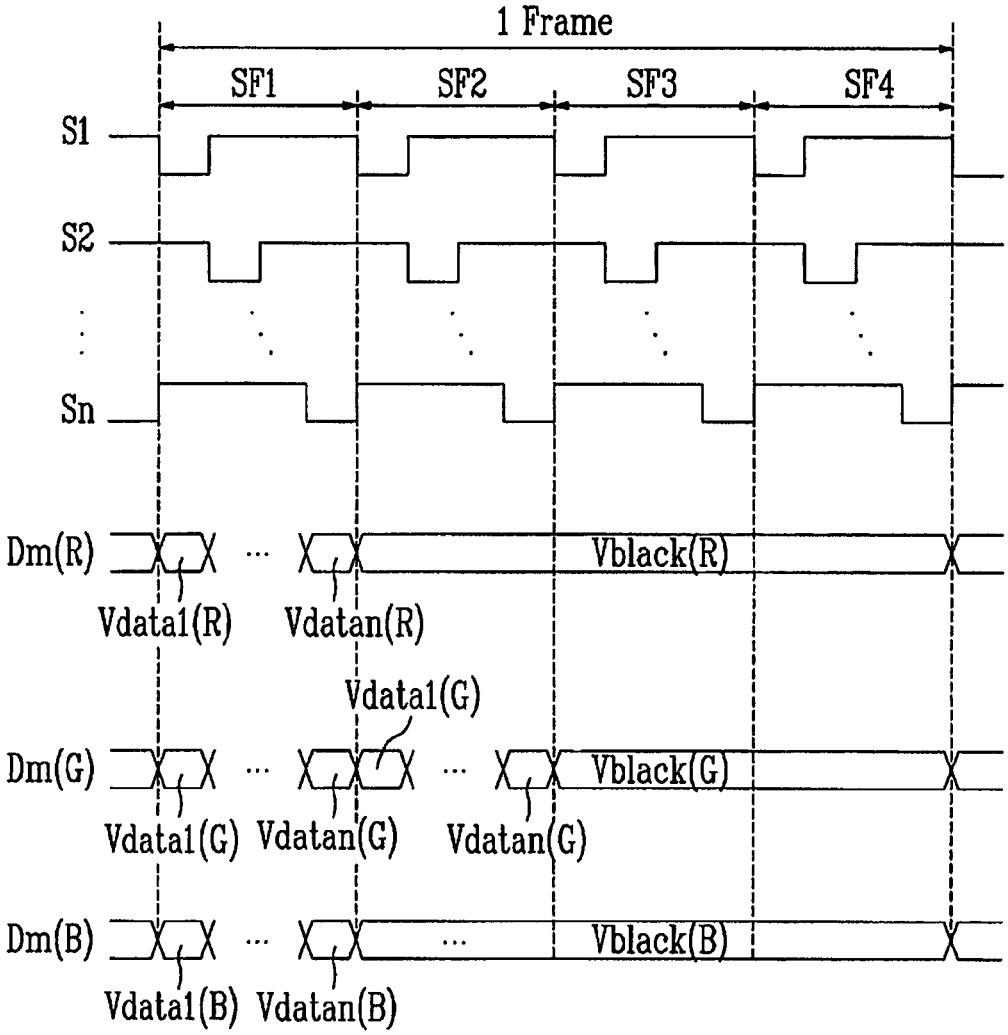
FIG. 8 is a timing chart for illustrating a method for driving the organic light emitting display shown in FIG. 5.

FIG. 8 is a timing chart for illustrating a method for driving the organic light emitting display shown in FIG. 5. Since light-emitting efficiency of an organic green light emitting diode OLED(G) is the lowest of organic light emitting diodes OLED(R), OLED(G), and OLED(B), the timing chart of FIG. 8 is one example of a case that adjusts a white balance by making a light emitting period of the organic green light emitting diode OLED (G) longer.

Referring to FIG. 5 and FIG. 8, one frame is composed of a plurality of sub-frames. More particularly, the one frame of FIG. 4 is shown to be composed of 4 sub-frames SF1, SF2, SF3, and SF4. A scan signal is sequentially supplied to the scan lines S1 to Sn during respective sub-frame periods.

In a case of red data lines Dm(R) applying a data voltage to red pixels, the first sub-frame SF1 functions as a light-emitting sub-frame. When the scan signal of the first sub-frame SF1 is supplied to the red pixels, data voltages $V_{data}$(R) to $V_{data}$ n(R) are applied to red data lines Dm(R). Accordingly, red pixels connected to the red data lines Dm(R) emit light corresponding to the data voltages $V_{data}$1(R) to $V_{data}$ n(R) that are applied during the first sub-frame SF1. The second to fourth sub-frames SF2 to SF4 function as non-light emitting sub-frames. When the scan signal of the second to fourth sub-frames SF2 to SF4 is supplied, a voltage $V_{black}$(R) corresponding to a black gradation is applied to the red data line Dm(R). As such, red pixels coupled with the red data lines Dm(R) display an image corresponding to the black gradation according to the voltage $V_{black}$(R) corresponding to the black gradation applied during the second to fourth sub-frames SF2 to SF4.

In a case of green data lines Dm(G) applying a data voltage to green pixels, the first and second sub-frames SF1 and SF2 function as light emitting sub-frames. When the scan signal of the first and second sub-frames SF1 and SF2 is supplied to the green pixels connected to the green data lines Dm(G), the green pixels emit light corresponding to data voltages $V_{data}$ 1(G) to $V_{data}$ n(G) applied to the green data lines Dm(G). The third and fourth sub-frames SF3 and SF4 function as non-light emitting sub-frames. When the scan signal of the third and fourth sub-frames SF3 and SF4 is supplied to the green pixels connected to the green data lines Dm(G), the green pixels display an image corresponding to the black gradation according to a voltage $V_{black}$(G) corresponding to the black gradation applied to the green data line Dm(G).

In a case of blue data lines Dm(B) applying a data voltage to blue pixels, the first sub-frame SF1 functions as a light-emitting sub-frame. When the scan signal of the first sub-frame SF1 is supplied to the blue pixels connected to the blue data lines Dm(B), the blue pixels emit light corresponding to data voltages $V_{data}$ 1(B) to $V_{data}$ n(B) applied to the blue data lines Dm(B). The second through fourth sub-frames SF2 through SF4 function as non-light emitting sub-frames. When the scan signal of the second through fourth sub-frames SF2 through SF4 is supplied to the blue pixels connected to the blue data lines Dm(B), the blue pixels display an image corresponding to the black gradation according to a voltage $V_{black}(B)$ corresponding to the black gradation applied to the blue data line Dm(B).

As described above, by diving one frame into light emitting sub-frames and non-light emitting sub-frames, and separately operating the light emitting sub-frames and the non-light emitting sub-frames, the uniformity of a luminance can be improved. The second embodiment of the present invention increases a driving time of an organic green light emitting diode of light having a relatively low light emitting efficiency, thereby adjusting a white balance.

Although the number of the sub-frames is four in FIG. 8, the present invention is not thereby limited. That is, as long as the number of the sub-frames is two or more, aspect(s) of the present invention can be realized. In FIG. 8, lengths of four sub-frames are identical with each other. However, even when lengths of sub-frames forming one frame are different from each other, aspect(s) of the present invention can be achieved. Further, in FIG. 8, although a case where the number of light emitting sub-frames of a green data line Dm(G) is different from that of the red data line Dm(R) or the blue data line Dm(B) is shown, a case in which the number of light emitting sub-frames of the green data line Dm(G), the number of light emitting sub-frames of the red data line Dm(R), and number of light emitting sub-frames of the blue data line Dm(B) are different from each other is included in the scope of the present invention. In FIG. 8, a light-emitting sub-frame is positioned at a front part of one frame. However, aspect(s) of the present invention can be realized, even if the light-emitting sub-frame is positioned at a middle or back part of one frame.

A voltage corresponding to a black gradation is a voltage required when a pixel displays the black gradation. However, since an error of a threshold voltage $V_{TH}$ can occur in every pixel, a voltage corresponding to the black gradation in one pixel can be a voltage corresponding to a gray gradation in another pixel having a threshold voltage of a great error. One example of the voltage corresponding to the black gradation may be a first source voltage VDD. The voltage $V_{black}(R)$ corresponding to the black gradation applied to the red data line Dm(R), the voltage $V_{black}(G)$ corresponding to the black gradation applied to the green data line Dm(G), and the voltage $V_{black}(B)$ corresponding to the black gradation applied to the blue data line Dm(B) may be the same as each other or different from each other.

For reasons similar to the organic light emitting display according to the first embodiment of the present invention, the organic light emitting display of the second embodiment of the present invention reduces an influence of an error of a threshold voltage on a luminance, thus improving uniformity of the luminance. Also, as indicated previously, the second embodiment of the present invention increases a driving time of an organic light emitting diode of light having a relatively low light emitting efficiency, thereby adjusting a white balance.

In general and as mentioned above, the organic light emitting display, and the method for driving an organic light emitting display and a pixel circuit according to an embodiment of the present invention improves luminance uniformity of an organic light display. The present invention can also divide one frame into a light emitting period and a non-light emitting period by using a widely used scan driver. Furthermore, the present invention can adjust a white balance.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An organic light emitting display comprising:

a scan driver for sequentially supplying a scan signal to a plurality of scan lines during each of a plurality of sub-frames included in one frame;

a data driver for applying differing analog data voltages to a plurality of data lines coupled to a plurality of pixels during at least one light emitting sub-frame of the plurality of sub-frames included in the one frame, the differing analog data voltages for controlling corresponding differing luminance of the plurality of pixels, and for applying a voltage corresponding to a black gradation to the plurality of data lines during at least two non-light emitting sub-frames of the plurality of sub-frames included in the one frame to improve a uniformity of a same luminance among respective ones of the plurality of pixels of the organic light emitting display device to which a same one of the analog data voltages is being applied, and to improve a differentiation of the same luminance among the respective ones of the plurality of pixels from different luminance among all others of the plurality of pixels to which different ones of the analog data voltages are being applied; and a pixel portion comprising the plurality of pixels, the pixel portion for displaying an image according to the scan signal supplied to the plurality of scan lines and according to the differing analog data voltages and the voltage corresponding to the black gradation applied to the plurality of data lines.

2. The organic light emitting display as claimed in claim 1, wherein the data driver includes:

a shift register for outputting a latch control signal in response to a clock signal and a synchronous signal;

a data latch for sequentially receiving video data according to the latch control signal from the shift register and for outputting the video data in parallel;

a digital/analog converter for converting an output of the data latch into ones of the differing analog data voltages and for outputting the analog data voltages; and a selector for outputting the analog data voltages output from the digital/analog converter to the data lines during the at least one light emitting sub-frame, and for outputting the voltage corresponding to the black gradation to the data lines during the at least two non-light emitting sub-frames.

3. The organic light emitting display as claimed in claim 1, further comprising a timing controller for applying a scan driver control signal to the scan driver, for applying a data driver control signal to the data driver, for applying video data corresponding to video data received during light emitting periods to the data driver, and for applying video data corresponding to the black gradation to the data driver during remaining periods.

4. The organic light emitting display as claimed in claim 1, wherein a first source voltage of a first voltage source and a second source voltage of a second voltage source are applied to the pixel portion, and the voltage corresponding to the black gradation comprises a voltage selected from the group consisting of the first source voltage and the second source voltage.

5. The organic light emitting display as claimed in claim 1, wherein the voltage corresponding to the black gradation is a voltage required when a pixel included in the pixel portion displays the black gradation.

6. A method for driving an organic light emitting display, the organic light emitting display including a scan driver for supplying a scan signal to a plurality of scan lines, a data driver for applying differing analog data voltages corresponding to differing luminance to a plurality of data lines, and a pixel portion comprising a plurality of pixels for displaying an image according to the scan signal supplied to the plurality of scan lines and according to the differing analog data voltages applied to the plurality of data lines, the differing analog data voltages for controlling corresponding said differing luminance of the plurality of pixels, the method comprising:

(a) sequentially supplying the scan signal to the plurality of scan lines, and applying the differing analog data voltages to the plurality of data lines during a light emitting period; and (b) sequentially supplying the scan signal to the plurality of scan lines, and applying a predetermined voltage to the plurality of data lines during each of two contiguous non-light emitting periods to improve a uniformity of a same luminance among respective ones of the plurality of pixels of the organic light emitting display device to which a same one of the analog data voltages is being applied, wherein the applying of the predetermined voltage further comprises applying the predetermined voltage to improve a differentiation of the same luminance among the respective ones of the plurality of pixels from different luminance among all others of the plurality of pixels to which different ones of the analog data voltages are being applied.

7. The method as claimed in claim 6, wherein the predetermined voltage is a voltage corresponding to a black gradation.

8. A method for driving a plurality of pixel circuits by differing analog data voltages for generating corresponding differing currents corresponding to differing luminance during one frame, each of the plurality of pixel circuits including a first transistor for applying an analog data voltage of the differing analog data voltages to a data line according to a scan signal supplied to a scan line, a capacitor for storing a voltage corresponding to the applied analog data voltage, and a second transistor for applying a current of the differing currents corresponding to the voltage stored in the capacitor to an organic light emitting diode and for driving the organic light emitting diode to a corresponding luminance of the differing luminance, the one frame including at least one light emitting sub-frame and at least two non-light emitting sub-frames, the method comprising:

during the at least one light emitting sub-frame, for each of the plurality of pixel circuits:

storing a first voltage in the capacitor corresponding to a first analog data voltage from among the differing analog data voltages being applied to the data line while the scan signal is supplied to the scan line; and applying a first current of the differing currents corresponding to the first voltage stored in the capacitor to the organic light emitting diode to output a first luminance of the differing luminance corresponding to the first analog data voltage;

during a first of the at least two non-light emitting sub-frames, for each of the plurality of pixel circuits:

storing a second voltage in the capacitor corresponding to a black gradation voltage being applied to the data line while the scan signal is supplied to the scan line; and applying a second current corresponding to the second voltage stored in the capacitor to the organic light emitting diode to improve a uniformity of the first luminance of the organic light emitting diode connected to respective ones of the plurality of pixel circuits to which the first analog data voltage is being applied, wherein the applying of the second current during the first of the at least two non-light emitting sub-frames comprises applying the second current to improve a differentiation of the first luminance of the organic light emitting diode connected to the respective ones of the plurality of pixel circuits from different luminance of the organic light emitting diode connected to all others of the plurality of pixel circuits to which different ones of the analog data voltages are being applied; and during a second of the at least two non-light emitting sub-frames, for each of the plurality of pixel circuits:

storing the second voltage in the capacitor corresponding to the black gradation voltage being applied to the data line while the scan signal is supplied to the scan line; and applying the second current corresponding to the second voltage stored in the capacitor to the organic light emitting diode to further improve the uniformity of the first luminance of the organic light emitting diode connected to the respective ones of the plurality of pixel circuits to which the first analog data voltage is being applied, wherein the applying of the second current during the second of the at least two non-light emitting sub-frames further comprises applying the second current to further improve the differentiation of the first luminance of the organic light emitting diode connected to the respective ones of the plurality of pixel circuits from the different luminance of the organic light emitting diode connected to all the others of the plurality of pixel circuits to which the different ones of the analog data voltages are being applied.

9. The method as claimed in claim 8, wherein a first source voltage of a first voltage source is applied to a source of the second transistor, and the black gradation voltage is the first source voltage.

10. The organic light emitting display as claimed in claim 1, wherein each of the plurality of sub-frames included in the one frame has a same time period.

* * * * *